US007740155B1

(12) United States Patent
Gallegos

(10) Patent No.: US 7,740,155 B1
(45) Date of Patent: Jun. 22, 2010

(54) SELF CLOSING CAP FOR DISPENSING FLUIDS

(76) Inventor: Yuri Mauricio Gallegos, C/ Pep Ventura #59, 3er, 1er, Sant Pere de Ribes, BN (ES) 08810

( * ) Notice: Subject to any disclaimer, the term of this patent is extended or adjusted under 35 U.S.C. 154(b) by 663 days.

(21) Appl. No.: 11/673,547

(22) Filed: Feb. 9, 2007

Related U.S. Application Data

(60) Provisional application No. 60/746,142, filed on May 1, 2006.

(51) Int. Cl.
*B65D 35/50* (2006.01)

(52) U.S. Cl. ..... 222/494

(58) Field of Classification Search ..... 222/494
See application file for complete search history.

(56) References Cited

U.S. PATENT DOCUMENTS

| | | | | | |
|---|---|---|---|---|---|
| 1,973,459 | A | | 9/1934 | Anderson | |
| 2,272,653 | A | | 2/1942 | Andrews | |
| 2,596,592 | A | | 5/1952 | Parker | |
| 2,611,515 | A | | 9/1952 | Smith | |
| 3,081,769 | A | * | 3/1963 | Ackerman | 401/196 |
| 3,107,035 | A | | 10/1963 | Cholet | |
| 3,154,222 | A | | 10/1964 | Heckmann | |
| 3,244,332 | A | | 4/1966 | Rogers | |
| 3,545,682 | A | * | 12/1970 | Beard | 222/494 |
| 4,148,420 | A | | 4/1979 | Morrissette | |
| 4,457,453 | A | | 7/1984 | Stevens | |
| 4,474,314 | A | * | 10/1984 | Roggenburg, Jr. | 222/494 |
| 4,699,300 | A | * | 10/1987 | Blake | 222/494 |
| 4,878,774 | A | * | 11/1989 | Karasin et al. | 401/15 |
| 6,116,445 | A | | 9/2000 | Ikemori | |
| 6,561,371 | B2 | | 5/2003 | Sciarini | |
| 6,953,297 | B2 | * | 10/2005 | Dobbs et al. | 401/188 R |
| 7,104,415 | B2 | | 9/2006 | Reutter | |

FOREIGN PATENT DOCUMENTS

EP 296004 A1 * 12/1988

OTHER PUBLICATIONS

European Patent Office Machine Translation of EP 2960004 to Belmont (Document "N" above).*

* cited by examiner

*Primary Examiner*—Kenneth Bomberg

(57) ABSTRACT

A self closing cap for dispensing fluids that is composed of a cap (10) with a rotating-lid (40) on top. The cap (10) having a cylindrical shape with holes (16) and channels (12) (14) on top to direct the fluids and an opening on the bottom to be mounted on a container (FIG. 1). Also the cap has a rotating lid (40) on top that works as a diaphragm (44), opening and closing according with the pressure of the fluid behind it and not allowing any substances to enter inside the cap (10). The rotating-lid (40) also has a plurality of pads (48) able to block and open the holes (16) on the cap (10) to permit the fluid to exit as the user desires (FIG. 8A).

6 Claims, 6 Drawing Sheets

SELF CLOSING CAP FOR DISPENSING FLUIDS

CROSS-REFERENCE TO RELATED APPLICATIONS

This application claims the benefit of patent application Ser. No. 60/746,142, filed May 1, 2006 by the present inventor.

FEDERALLY SPONSORED RESEARCH

None.

SEQUENCE LISTING

None.

BACKGROUND OF THE INVENTION

1. Field of Invention

This invention generally relates to a cap for fluids that will act as a check valve to let the fluid inside a container exit without difficulty, but at the same time will impede the entrance of other substances like air, water and dirt into the container.

2. Prior Art

Previously all caps were made just to open and close, leaving the fluid inside the container open to any kind of contamination. Later, inventors started to solve this problem, adding a closeable lid that the user must close to prevent any extraneous fluids or particle(s) from entering inside the container (e.g., flip-top caps). Sometimes this works well enough. However, in some cases, such as creams that can easily get oxidized with air and reduce their potency, this situation becomes critical. At the same time, some fluids used in medical applications need to stay clean and free of contaminants to be safe to use for human applications. All the plastic caps heretofore known in the market suffer from a number of disadvantages:

(a) All caps currently available in the market allow air to enter in the container. This can result in oxidation of the substance inside the container, it will get damaged or change its properties over time. An example would be an anti-age cream with certain vitamins that in contact with air will change color, thicken and oxidize, losing their anti-aging properties. Another example is a cream that helps to heal scars, but is not effective if put into contact with oxygen. These creams are usually very expensive.

(b) On a normal cap, any contaminants coming from the exterior can enter the container through the cap contaminating and damaging the formula of a medical product. This is especially critical in medical applications where bacteria or other microorganism can enter the container and grow inside. Later the patient who is taking this formula can get infected by the bacteria or other microorganism. This can happen to patients with a low immune system, who can die from an airborne disease coming from the container that has the medicine that is supposed to cure them, rather than infecting them.

(c) The cap needs to have the lid closed to prevent any contaminant from entering the container. Sometimes people do not like to close the lid, forget or do not have time to do it. For example, when dispensing a diaper rash cream, if the baby moves around all the time, there is not time to close the cream while putting a diaper on the baby after using the cream.

(d) The cap also needs to be closed to prevent any fluid inside the container from spilling

OBJECT AND ADVANTAGES

Accordingly several objects and advantages of the invention are:

(a) To provide a cap that will act as a check valve when dispensing the product inside. Allowing the product, usually a fluid or fluid-like substance or cream, to exit, but at the same time not permitting the entrance of air, water, bacteria, microorganisms, dirt and other undesirable substances inside the container.

(b) To provide a cap that seals itself, so that no harm will come to the contents of the container if the user forgets to close the cap.

(c) To provide a cap that can be easily injection molded and manufactured very easily.

(d) This cap will be also available with massaging ribs to provide an easier experience when dispensing a cream or other product on the skin. This will help spread the cream or product better with a massaging action and facilitate the absorption of the cream or product by the skin.

(e) To provide a cap that can be set ready to dispense with just one twist of the lid, and to close to prevent any spill with another twist of the lid.

Further objects and advantages will become apparent from a consideration of the ensuring description and drawings.

SUMMARY

In accordance with the present invention, a self closing cap for dispensing fluids or fluid-like substances comprises a cap with a rotatable lid that is mounted on a container, such as, but not limited to, a collapsible plastic tube. The self closing cap will open only to let the fluid or fluid-like substance exit, and when the desired amount of fluid or fluid-like substance has exited, it will automatically close to prevent any air or other substances from entering the container.

DRAWINGS

Figures

In the drawings, closely related figures have the same number but different alphabetic suffixes.

DRAWINGS

Reference Numerals

10 Cap.
12 Radial channels.
14 Circumferential channel.
16 Raised-hole.
18 External-catch.
20 Dome.
22 Internal-catch.
24 Ribs.
26 Ring-seal.
28 Hole-membrane.
40 Rotating-lid.
42 Center-hole.
44 Diaphragm.
46 Undercut.
48 Pads.
50 Sealing-lip.
52 Knurl.
54 Internal wall.
60 Snap-on-tube.
62 Catch.
64 Tube-hole.
66 Tube-ribs.
90 Soft top.
92 Lumps.
94 Membrane.
96 Hole.

DETAILED DESCRIPTION

Preferred Embodiment—FIGS. 1, 2, 3, 4, 5, 6, 7, 8A and 9

Figure 7:
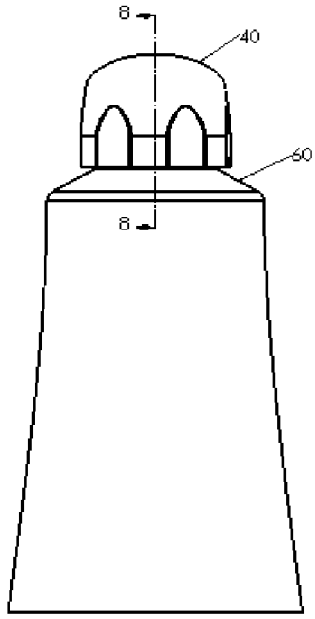
FIG. 7 is a front view of my invention mounted on a tube.
Figure 8A:
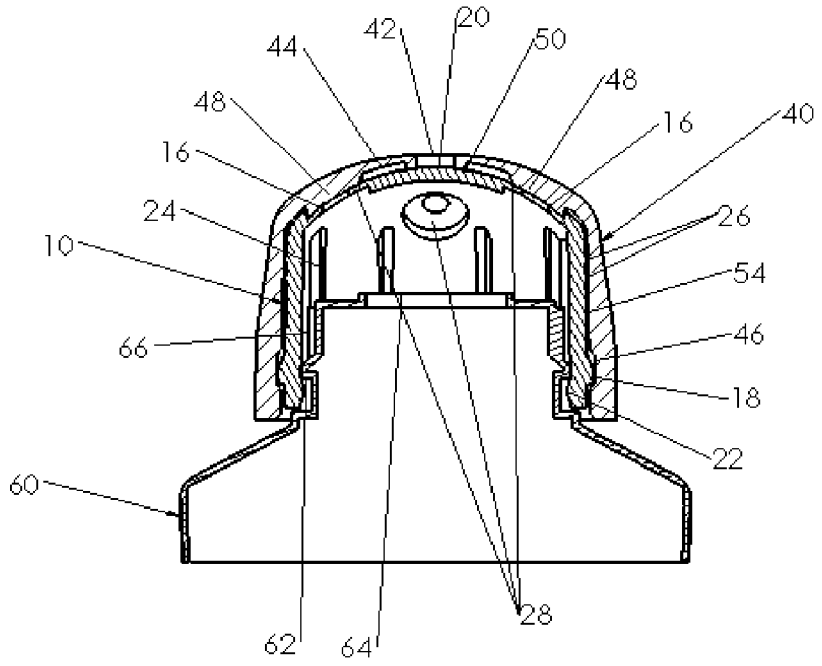
FIG. 8A is a cross-sectional view of my invention taken from line 8-8 in FIG. 7.
Figure 9:
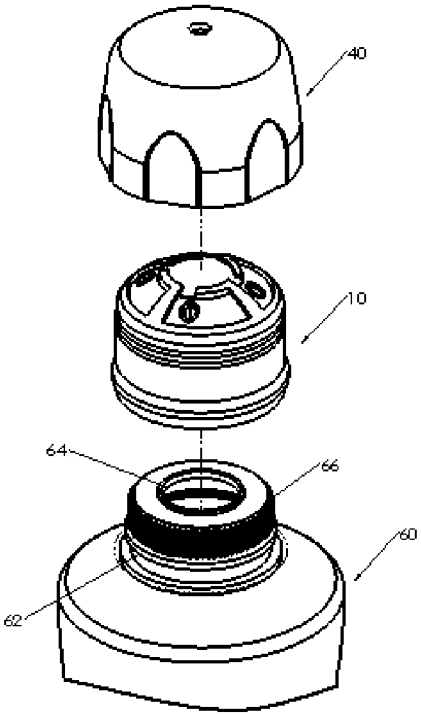
FIG. 9 is an exploded view of my invention.
Figure 10:
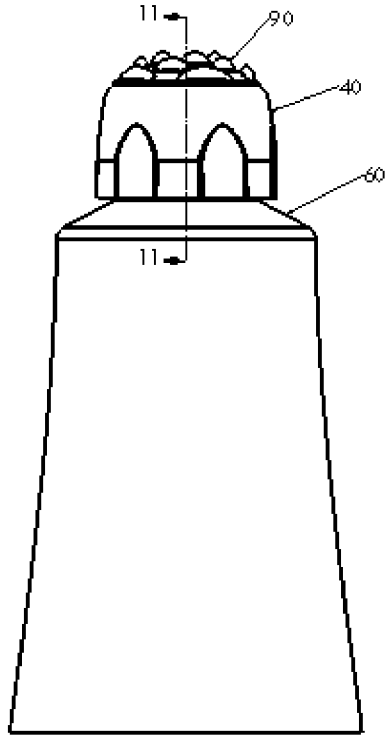
FIG. 10 is a front view of a second embodiment of my invention.
Figure 11:
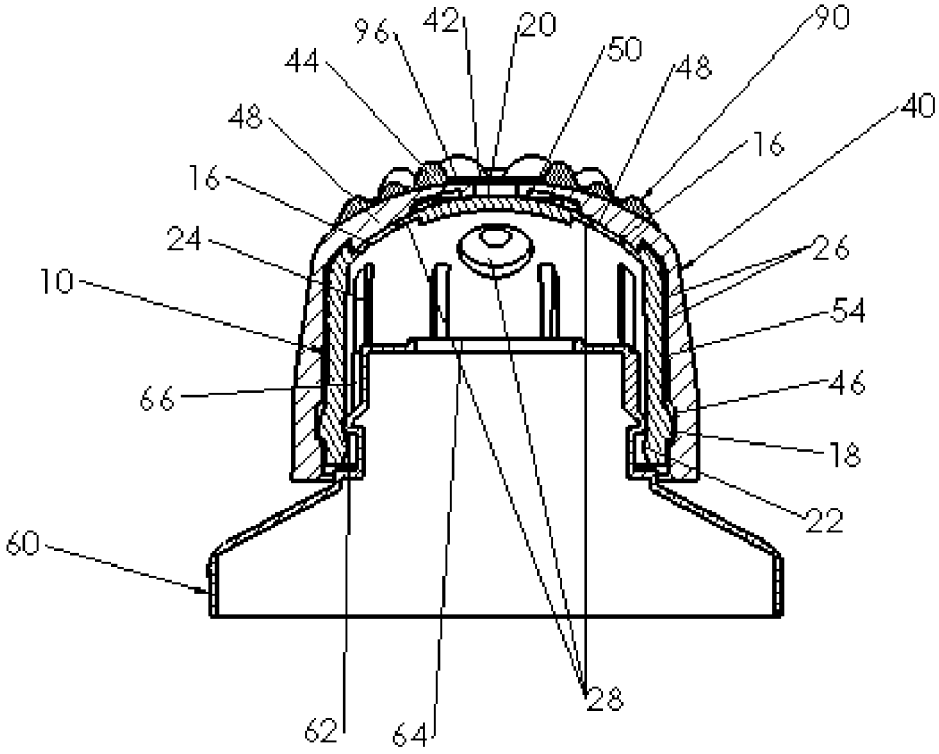
FIG. 11 is a section view of a second embodiment taken from line 11-11 in FIG. 10.
Figure 12:
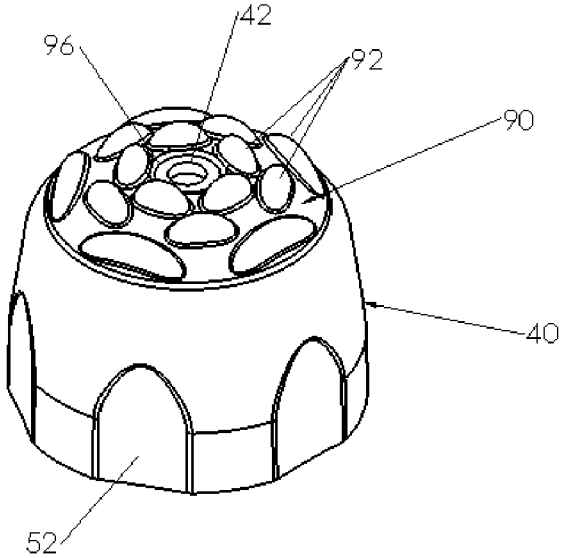
FIG. 12 is an isometric view of a second embodiment of my invention.

A preferred embodiment of the closure of the present invention is illustrated in FIG. 7 front view of my invention mounted on a plastic tube 60. While this is my preferred embodiment, many alternative embodiments are possible, and the specificities listed below should not be construed as limiting the scope of the invention, but merely as providing illustrations of the preferred embodiment. FIG. 8A, which is a cross-sectional view taken at line 8-8, gives an interior view of how the components are arranged. FIG. 9 shows an exploded view of my invention.

Figure 1:
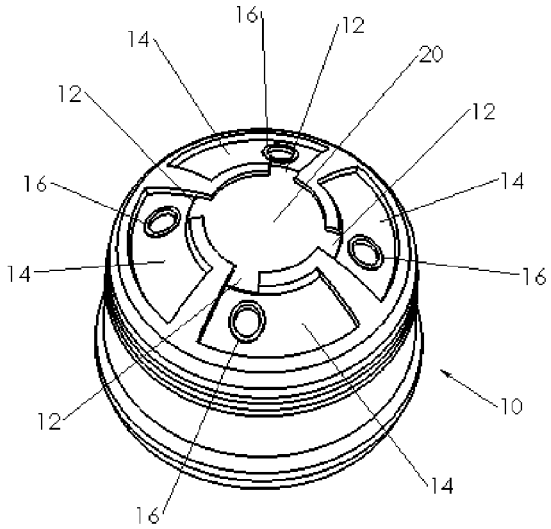
FIG. 1 is a perspective view of the cap.
Figure 2:
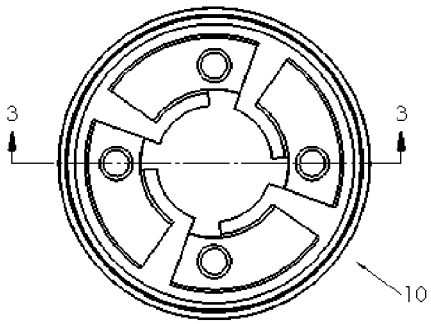
FIG. 2 is a plan view of the cap.
Figure 3:
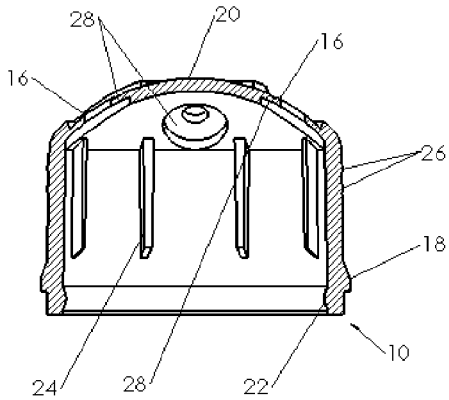
FIG. 3 is a cross-sectional view of cap taken from line 3-3 in FIG. 2.

The cap 10 shown on FIG. 1 has on the top of its surface a plurality of radial-channels 12, which connect to a plurality of wider circumferential-channels 14. Inside the circumferential-channel 14 there are a plurality of raised-holes 16, which are holes with a raised edge around them. The raised-holes communicate to the inside. On the top there is a dome 20. A section view (FIG. 3) of the cap 10 shows the external-catch 18 and the internal-catch 22 that is used to install it on a tube or pouch 60. Underneath each raised-hole 16 there is a membrane 28. The inside of the cap 10 has a plurality of ribs 24. The cap 10 is made of injected plastic, and preferably polypropylene (PP), although polyethylene can be also used. The cap 10 has also a plurality of ring-seals 26 that will touch the internal-wall 54 of the rotating-lid 40 (FIG. 8A). The size of the cap is based on the standard tubes that can be found on the market, although many other tube or container sizes or shapes could be used. For this figure a tube with a nominal diameter of 40 mm and with a neck of 20 mm diameter was chosen.

Figure 4:
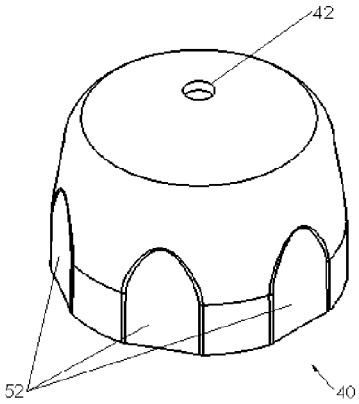
FIG. 4 is a perspective view of the rotating-lid.
Figure 5:
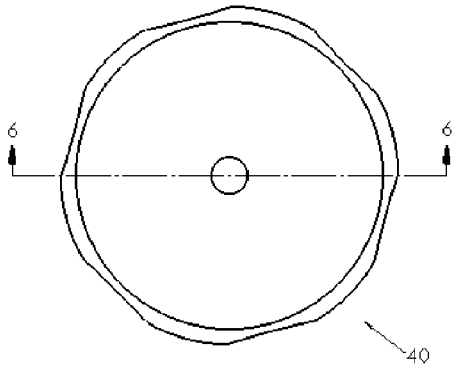
FIG. 5 is a plan view of the rotating-lid.
Figure 6:
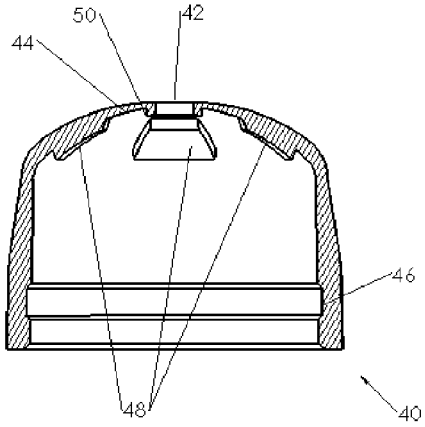
FIG. 6 is a cross-sectional view of the rotating-lid taken from line 6-6 in FIG. 5.

The rotating-lid 40 shown in FIG. 4 has on top a 3 mm diameter center-hole 42, and on the sides a plurality of knurls 52. FIG. 6 shows a cross-sectional view taken from FIG. 5 at line 6-6 that shows a plurality of the pads 48 each matching the same number of raise-holes 16. The top of the rotating-lid has a reduced thickness to form a diaphragm 44 which includes a sealing-lip 50. The rotating-lid 40 is made of injection molded plastic and preferably of either a low or high density polyethylene (LDPE-HDPE) or a softer polypropylene (PP).

FIG. 9 shows the components of the invention in an exploded view showing a snap-on-tube 60, on top of which will be mounted the cap 10 with the rotating-lid 40.

Operation

Figure 8B:
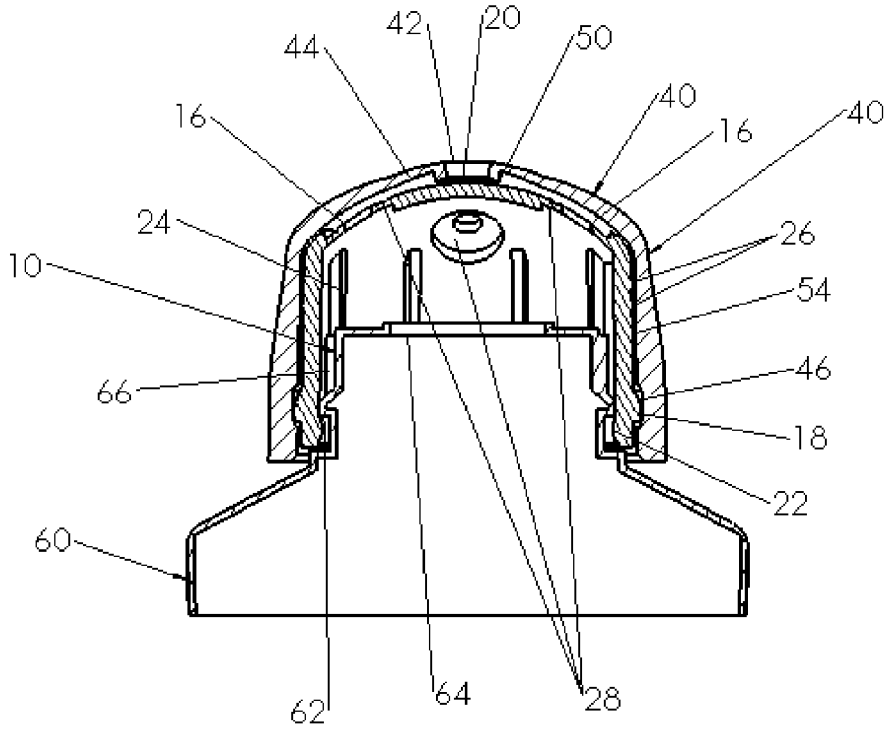
FIG. 8B is a section view of my invention during operation taken from line 8-8 in FIG. 7.

Preferred Embodiment—FIGS. 7, 8*a*, 8*b*

In operation a person uses the self-closing-cap in the following manner. When the rotating-lid 40 is rotated in a counter clock-wise direction the pads 48 move of the way and open the raised-holes 16 on the cap (FIG. 8B). At the same time the snap-on-tube 60 receives some pressure from when the user presses the snap-on-tube 60. This pressure makes the fluid flow. The fluid gets inside the cap 10, and through the raised-holes 16. The fluid continues its way to the circumferential-channel 14, and into the radial-channel 12 (FIG. 1) where it starts lifting up the diaphragm 44 of the rotating-lid 40 which raises with the sealing-lip 50 and leaves the fluid to exit to the exterior through the center hole 42 This is shown in FIG. 8B that shows the diaphragm 44 displaced from its normal position. Once a certain amount of fluid is dispensed, the user releases the pressure on the snap-on-tube 60, and stops the flow. At this point the diaphragm 44 of the rotating-lid 40 recovers its original form using its plastic properties and seals the sealing-lip 50 on the dome 20 of the cap 10 closing the passage to the center-hole 42. At this point the user could rotate clockwise the rotating-lid 40 closing the raised-holes 16 and preventing the occurrence of any spills if someone accidentally presses the snap-on-tube 60 (FIG. 8A).

The cap 10 is attached by an internal catch 22 which matches the external catch 62 of the snap-on-tube 60 to keep it from falling (FIG. 8A). The ribs 24 will grab onto the tube-ribs 66 of the snap-on-tube 60 to keep the cap 10 fixed in the same position and unable to rotate.

The rotating-lid 40 will be mounted using the undercut 46 to grab onto the external-catch 18 of the cap 10 (FIG. 8A). The pads 48 will match the circumferential-channel 14 of the cap and will cover or open the raised-holes 16.

The raised-holes 16 have a 0.10 mm raised border around the hole that will help seal better against the pads 48. At the same time the hole-membranes 28 will give them some flexibility to follow better the shape of the pads 48 to help seal better (FIG. 8A).

The cap 10 ring-seals 26 are in contact to the internal-wall 54 of the rotating-lid 40. They seal against any fluid or fluid-like-substance from escaping from this connection (FIG. 8A).

Description

Alternative Embodiment—FIGS. 10, 11, 12, 13, 14, 15

Figure 13:
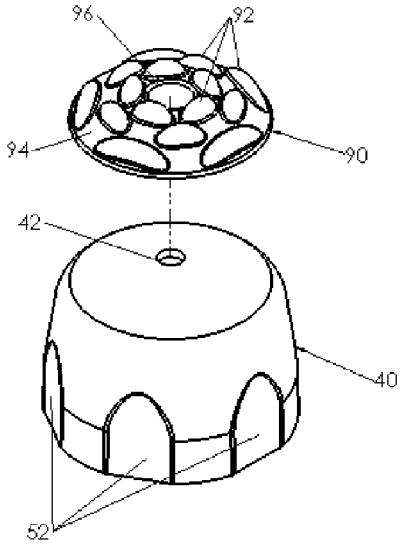
FIG. 13 is an exploded view of a second embodiment of my invention.
Figure 14:
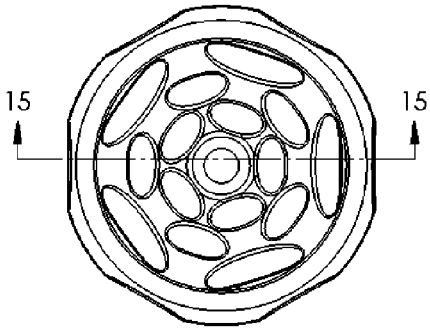
FIG. 14 is a plan view of the rotating-lid of a second embodiment.
Figure 15:
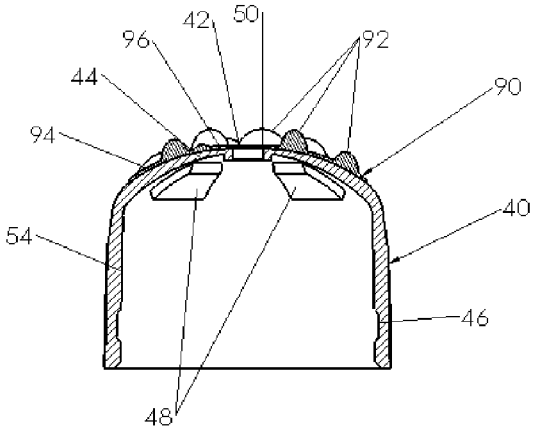
FIG. 15 is a cross-sectional view of the rotating-lid of a second embodiment of my invention taken from line 15-15 in FIG. 14.

In this embodiment the rotating lid 40 has on top a softer-top 90 (FIGS. 10,11,12) which can be over-molded or bi-injected from a different but not limited to a softer material as an thermoplastic-elastomer (TPE) as the ones provided by the brand Santoprene™. This softer-top 90 (FIG. 13), which would usually be a round, or oval shape, is formed by a membrane 94 that has a plurality of lumps 92 on top arranged in different shapes. The membrane 94 has a hole 96 of an appreciable diameter in the center. FIG. 13 shows an exploded view of the soft-top 90 and the rotating-lid 40.

The operation of this embodiment is similar to the preferred embodiment already described with the exception that the softer-top 90 will be used to provide some massaging effect on the user's skin to spread better the fluids and fluid-like-substances inside the snap-on-tube 60.

CONCLUSION, RAMIFICATIONS, AND SCOPE

Accordingly the reader will see that, according with the invention, I have provided an improved cap for dispensing fluids and fluid-like-substances that will avoid spills and contaminants entering the container. This economical solution can be used by persons of almost any age. The self-closing-cap has many other advantages in that:

- It permits the fluids and fluid-like-substances to exit without difficulty.
- It is easy and cheap to manufacture, with only a few components, which protects the environment.
- Its components are made of Polypropylene and Polyethylene that are both recyclable and biodegradable.
- It provides a safe way to store special substances (e.g., medicines, anti-aging creams) keeping them safe from contamination.
- It can be injection molded in many color combinations or even be transparent, giving it a unique look.
- Kids and adults are able to use it very quickly, with minimal training.

While the above description contains many specificities, these should not be construed as limitations on the scope of the invention, but as exemplifications of the presently preferred embodiments thereof. Many other ramifications and variations are possible within the teachings of the invention. For example:

- The soft-top can be made of different shapes and materials and having a plurality of holes instead of only one which will make it better at dispensing a fluid or fluid-like substance on the skin or other surfaces.
- The cap and rotating-lid can be made in different materials from the ones specified here.
- The cap can be mounted on a screw-on-tube instead of a snap-on-tube as specified here.
- The cap can be used to fit many of the different plastic tube sizes that are available.
- A different container can be used such as a bottle container, connected directly to a hose, or another type of container.
- The rotating-lid and cap can have many different shapes, such as circular, oval, triangular, trapezoidal, etc.
- The cap and the rotating-lid can be injection molded as one part and later put together with a connection in between that would be a tamper proof feature that could be broken by the user before he/she uses the cap.
- The components (such as the rotating lid and the cap) can be made in more than one color, allowing the user to see at a glance if the cap is open or closed.

Thus the scope of the invention should be determined by the appended claims and their legal equivalents, and not by the examples given.

I claim:

1. A dispenser device that closes by itself comprising:

(a) a cap having a top surface with a plurality of circumferential channels and a plurality of raised holes inside the circumferential channels;

(b) a rotating lid having a plurality of pads on a bottom surface thereof matching the circumferential-channels;

(c) said rotating lid mounted on said cap; and (d) said pads seated in said circumferential channels closing and opening said raised holes upon rotation of said rotating lid.

2. The dispenser device of claim 1, wherein said cap is made of plastic.

3. The dispenser device of claim 1, wherein said rotating lid is made of plastic.

4. The dispenser device of claim 1, further comprising:

a plurality of massaging lumps on a top surface of the rotating lid.

5. The dispenser device of claim 4, wherein said lumps are made of plastic.

6. The dispenser device of claim 4, wherein said lumps are made of thermoplastic elastomer.

* * * * *